US005153025A

United States Patent [19]

Klebl et al.

[11] Patent Number: 5,153,025

[45] Date of Patent: Oct. 6, 1992

[54] METHOD FOR THE CONTINUOUS MARKING OF ELONGATED MATERIAL

[75] Inventors: Wolfram Klebl, Isernhagen; Rainer Brünn, Essel, both of Fed. Rep. of Germany

[73] Assignee: kabelmetal electro Gesellschaft mit beschränkter Haftung, Hanover, Fed. Rep. of Germany

[21] Appl. No.: 621,244

[22] Filed: Nov. 30, 1990

[30] Foreign Application Priority Data

Dec. 22, 1989 [DE] Fed. Rep. of Germany ..... 3942483

[51] Int. Cl.[5] ..... B05D 5/00; B05D 1/02

[52] U.S. Cl. ..... 427/118; 427/8; 427/286; 427/424

[58] Field of Search ..... 118/DIG. 21, 325; 427/118, 163, 286, 261, 8, 424

[56] References Cited

U.S. PATENT DOCUMENTS 3,638,612 2/1972 Hoise et al. ..... 427/286 X 4,554,179 11/1985 Roderburg ..... 427/163

FOREIGN PATENT DOCUMENTS 1465660 1/1973 Fed. Rep. of Germany .

OTHER PUBLICATIONS

Young, Carol, "The New Penguin Dictionary of Electronics", New York, Viking Penguin, Inc., 1985, p. 348.

*Primary Examiner*—Evan Lawrence

*Attorney, Agent, or Firm*—Martin A. Faber

[57] ABSTRACT

There is disclosed a method for the continuous marking of electric strands with which annular markings, which are limited in axial direction, are applied to the surface of the strands by means of color jets. The color jets emerge under pressure from at least one nozzle which is driven by an electrical oscillation system, the frequency of which is controlled proportionally to a rate of withdrawal of the strands. For an easy changing of the axial distance between the markings, square pulses are fed to the oscillation system from a converter which converts electrical d.c. voltage into a square waveform signal at a specific frequency. The square waveform drives the oscillation system at the specific frequency. As a desired value, the converter is fed a d.c. voltage which is proportional to the rate of withdrawal of the strand.

5 Claims, 1 Drawing Sheet

METHOD FOR THE CONTINUOUS MARKING OF ELONGATED MATERIAL

FIELD AND BACKGROUND OF THE INVENTION

The present invention relates to a method for the continuous marking of elongated material, such as a wire strand, which is moved in its longitudinal direction, in which method, ring-shaped markings which are limited in axial direction are applied to the surface of the material by means of color jets. The color jets emerge under pressure from at least one oscillating nozzle which is driven by an electrical oscillating system, and impinge at a right angle to the direction of movement of the material onto the surface thereof. A frequency of the oscillation system is controlled to be proportional to a rate of removal of the material at which the material is moved past the nozzle (Federal Republic of Germany Patent 14 65 660).

"Elongated Material" within the meaning of the invention is, for instance, electrical lines, such as, for instance, control lines or else insulated strands of communications cables to which the following description refers by way of example for all other applications. Instead of the words "elongated material" there will accordingly be used the word "strand".

The color marking of strands is required for communications cables so that easy identification of individual strands is possible for installation. Thus, for example, in the case of four strands which are to be twisted to form a so-called "quad", rings are sprayed onto the insulation of three of these strands, each strand being marked differently. The fourth strand remains free. The marking of the three strands can be effected in the manner that the first strand is given single rings, the second strand double rings at short distances apart and the third strand double rings at larger distances apart. The strands can also be provided with markings in different colors.

Federal Republic of Germany Patent 14 65 660 describes a method in which a device is used which has become known by the commercial name "Colomat". By means of this device the markings are sprayed onto the insulation of the strands directly after application of the insulating material to the conductors of the strands. The frequency of the oscillation system and thus also the frequency of the nozzle are controlled as a function of the rate of removal of the strand. For this purpose there is used, for instance, a disk which is carried along by the strand and rotated thereby, and which is coupled to a sine wave generator. The output signal of the sine wave generator is converted into electrical pulses which serve to control the oscillation system. The frequency of the output signal determines the axial distance between the markings on the strand. This frequency is determined by the diameter of the disk. If the distance between the markings is to be changed, then another disk having another diameter must be used. This is not possible in continuous operation.

SUMMARY OF THE INVENTION

It is an object of the present invention further to develop the method described above in such a manner that the axial distance between the markings can be changed even in continuous operation.

According to the invention:

An oscillation system (10,11) is fed square pulses from a converter (25) which converts an electric d.c. voltage into a frequency, the square pulses predetermining the frequency of the oscillation system (10,11); and the converter (25) is fed, as a desired value, a d.c. voltage which is proportional to the rate of removal of the material (4).

By the use of the converter it is possible in simple manner to change the frequency of the oscillation system and thus alter the axial distance between the markings without anything having to be changed in the mechanical structure of the production device. The d.c. voltage which influences the frequency of the oscillation system can be produced as desired and very accurately, taking into account the rate of removal of the strand. The distance between the markings can, in particular, also be changed during continuous operation. By pre-establishing a corresponding desired value, it is also possible not to apply any markings at all on the strand for given lengths. On the whole, it is therefore possible with the method to change the distance between the markings with a constant rate of removal or to adapt the frequency of the oscillation system to maintain a uniform rate of removal of the strand in order to maintain a constant spacing between the markings.

According to a feature of the invention, there is used a converter (25) of a d.c. signal into a square wave signal having a mark-to-space ratio of 1:1.

Further according to the invention, the desired value to be given to the converter (25) is produced by a computer (28) which takes into account the rate of removal of the material (4).

Still further, the desired value to be given to the converter (25) is set by hand by use of a potentiometer.

Additionally according to the invention, the frequency of the oscillation system (10,11) is reduced to "0" if no markings (6) are to be applied to the material for a rather long period of time, and the nozzle (12,13) is simultaneously maintained by a "0" position controller (29) in an oblique position which is not directed at the material (4).

BRIEF DESCRIPTION OF THE DRAWING

With the above and other objects and advantages in view, the present invention will become more clearly understood in connection with the detailed description of a preferred embodiment, when considered with the accompanying drawing, of which.

DETAILED DESCRIPTION OF THE PREFERRED EMBODIMENT

We will continue to use also in the following description the word "strand" instead of the words "elongated material". There may be concerned in particular a strand which is intended for a communication cable.

Figure 1:
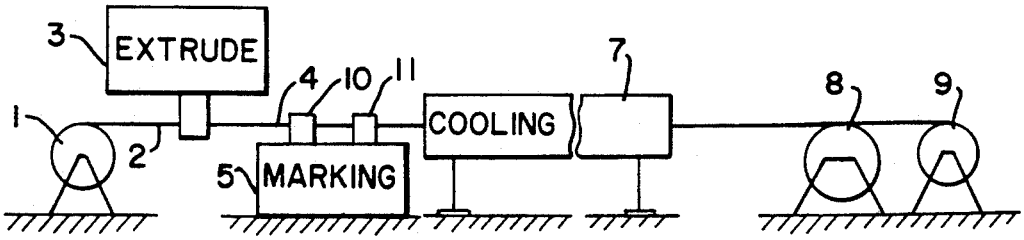
FIG. 1 is a diagrammatic showing of a device for carrying out the method of the invention.
Figure 2:
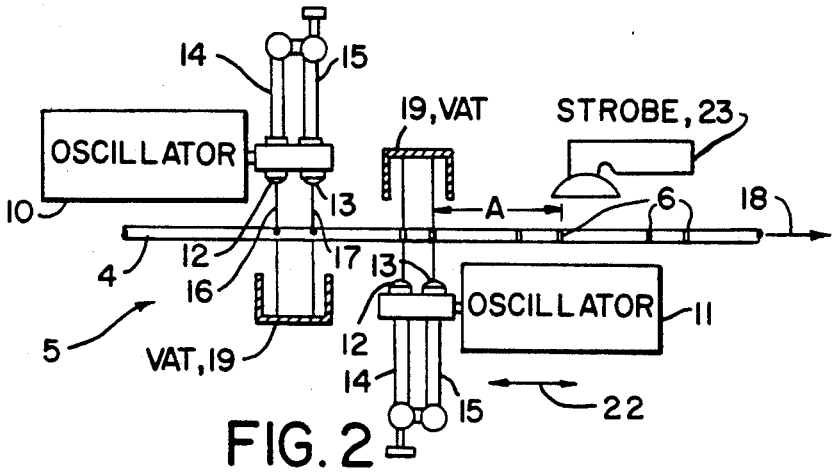
FIG. 2 is a device used in the method for producing markings, shown on a larger scale.

A wire (2) which consists, for instance, of copper is pulled off a reel (1), an insulation being applied to the wire in an extruder (3) in order to produce a strand 4. In a marking unit (5) markings (6) (FIG. 2) are applied to the strand (4) emerging from the extruder 3. In the embodiment shown, two markings (6) are applied simultaneously. The method is also suitable for applying only one marking (6) or more than two markings (6) on the strand (4). After passing through a cooling path (7), the strand (4) is wound onto a reel (8). The strand (4) is moved through the entire unit by means of a withdrawal device (9).

The marking unit (5) includes two oscillation systems (10,11) which are driven electrically at a controllable frequency. Two sets of two nozzles (12,13) are connected respectively to the two oscillation systems (10,11) in the embodiment shown, the nozzles being supplied with color in a coloring agent supplied via feed lines (14,15). Color jets (16,17) emerge from the nozzles (12,13), the markings (6) being applied by the color jets to the strand (4). An arrow 18 indicates the direction of movement of the strand 4. The color jets (16,17) of both sets of nozzles are collected in vats (19). The color can be returned to the marking unit (5) in accordance with the arrows (20,21) (FIG. 3).

The nozzles (12) and (13) of the two oscillation systems (10,11) produce in each case half a ring of the markings (6) on the strand (4). The oscillation system (11) can be displaced in the direction of the double arrow (22) in order to insure that closed rings result in each case. A stroboscope (23) ca be used to check the covering of the corresponding half rings of the markings (6) during operation. If necessary, the oscillation system (11) is displaced. The oscillation system (10) or both oscillation systems (10,11) can, of course, also be displaceable in the direction of the double arrow (22).

Figure 3:
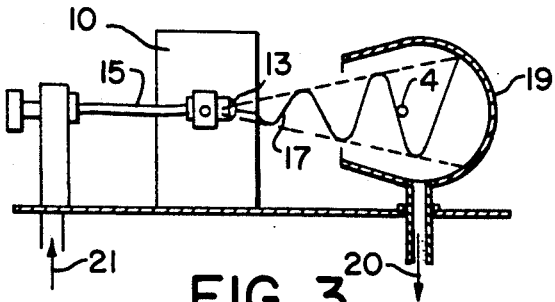
FIG. 3 shows a device according to FIG. 2 in a different view, again shown on a larger scale.
Figure 4:
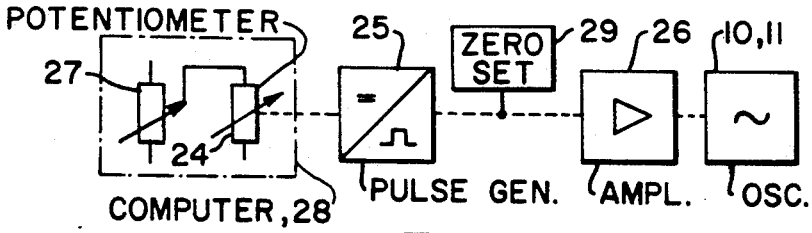
FIG. 4 is a block diagram of a circuit for carrying out the method.

As can be noted from FIG. 3, the nozzle (13) shown there oscillates with a pre-determinable amplitude so that the color jet (17) carries out an undulating movement. When the color jet (17) impinges on the strand (4), a half ring of the marking (6) is produced by this undulating movement. There then results one marking (6) each of the strand (4) at a distance which is determined by the frequency with which the nozzle (13) oscillates. The distance A between every two markings (6) depends on the rate of removal of the strand (4) and on the frequency of the oscillation systems (10,11) or the nozzles (12,13) respectively.

In order that the distance A correspond to the desired value and remain, in particular, constant in this connection, the frequency of the oscillation system (11) is controlled. For this purpose, a desired value which corresponds to the rate of removal of the strand (4) and which can be tapped off, for instance on a potentiometer (24) is used. This desired value is fed as d.c. voltage to a converter (25) which supplies square pulses. These square pulses are fed to the oscillation systems (10,11), possibly after amplification by an amplifier (26).

The distance A between the markings 6 depends on the mark-to-space ratio of the converter 25. The mark-to-space ratio is the ratio of the duration of the pulses to the pauses between the pulses. The oscillation systems (10,11) oscillate in this connection in such a manner that the color jets (16,17) produce a marking (6) both upon the ascending and upon the descending flank of each pulse. If the durations of pulses and pauses differ substantially from each other, then there would accordingly result permanently varying distances between the markings (6). It is therefore particularly advantageous to use a converter (25) having a mark-to-space ratio of 1:1.

Figure 5:
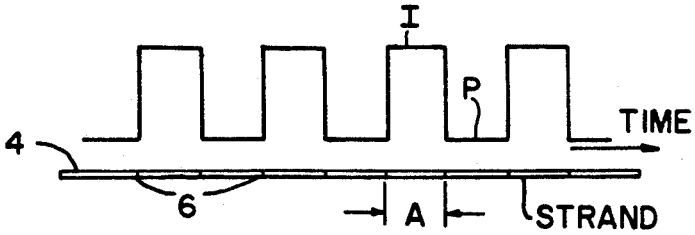
FIG. 5 shows the course of the output signal of a converter used.

Such a converter 25 supplies square pulses according to FIG. 5 in which the duration of the pulses I and of the pauses P amounts, for instance, to 5 msec, which corresponds to a frequency of 100 Hz. An oscillation system (10,11) controlled thereby then produces 200 markings per second. Upon each flank of the pulses I a marking (6) is produced on the strand (4). While FIG. 5 shows an idealized square waveform with vertical flanks (leading and trailing edges of each pulse) perpendicular to the time axis, a corresponding graph of movement of a nozzle (FIG. 3) would have flanks inclined slightly to the vertical due to inertia of the nozzle; this produces a rapid sweep of the nozzle past the strand 4. The distance A between the markings (6) can then be kept constant without any additional measures if the converter 25 maintains exactly a mark-to-space ratio of 1:1. With a withdrawal rate of, for instance, 600 m/min and the above-mentioned frequency of 100 Hz, the distance A between in each case two markings 6 amounts to 50 mm.

The desired value for the d.c. voltage can be derived particularly suitably from the so-called linear desired value which is present, for instance, on a potentiometer 27. Such a linear desired value is in principle present in any piece of machinery. It takes into account, in all cases, the rate of withdrawal of the parts to be produced or else the speed of rotation of rotating machine parts. The setting of the desired value of the d.c. voltage can then be effected manually in a simple embodiment with the potentiometer 24. It is, however, in principle also possible to use instead of the potentiometers 24 and 27 a computer 28 which replaces them and which is indicated by a dash-dot line.

If for longer lengths no markings are to be applied at all to the strand 4, then it is particularly simple to reduce the frequency of the oscillation systems to "zero" so that the nozzles (12,13) no longer oscillate. In order that the color jets (16,17) emerging from the nozzles do not impinge on the strand (4), the nozzles (12,13) are held, for instance, by a zero-position controller (29), in an oblique position which is not directed at the strand 4. For example, the controller 29 may be a grounding circuit which grounds a input signal to the amplifier 26 to hold the color jet nozzles at the oblique position.

We claim:

1. A method for the continuous marking of a strand of material which is moved in its longitudinal direction, the method providing ring-shaped markings which are limited in axial direction along the strand, and comprising:

applying markings to a surface of the strand by means of color jets which emerge under pressure from at least one nozzle;

oscillating the nozzle by means of an electrical oscillation system to bring a color jet to impinge at a right angle to a direction of movement of the strand onto the surface thereof;

controlling a frequency of the oscillation system in proportion to a rate of movement of the strand passing the nozzle;

generating a square wave electrical pulses by generating means operative to provide a frequency of the square wave in proportion to a d.c. voltage;

operating the generating means to produce the square waveform with a mark-to-space ratio of 1:1;

feeding the square wave electrical pulses to the oscillation system for designating an operating frequency of the oscillation system; and feeding as a desired value the d.c. voltage to the generating means, the d.c. voltage being proportional to the rate of movement of the strand.

2. A method according to claim 1, further comprising employing a computer to provide the desired value to input said d.c. voltage to said generating means by accounting for the rate of movement of the strand.

3. A method according to claim 1, further comprising setting said d.c. voltage by hand.

4. A method according to claim 1, further comprising reducing the frequency of the oscillation system to zero if no markings are to be applied to the strand; and maintaining said at least one nozzle simultaneously in an oblique position which is directed away from the strand.

5. A method for continuous marking of a strand of material, during movement of the strand in its longitudinal direction, with ring-shaped markings, comprising:

employing a nozzle to produce a color jet;

oscillating the nozzle transversely to the longitudinal direction of the strand, by means of an electrical oscillation system, to enable the color jet to impinge upon the strand to impart a marking to the strand;

providing an input voltage to the oscillation system proportional to a rate of the movement of the strand;

generating, in the oscillation system, a square-wave electrical signal at a pulse-repetition frequency proportional to the input voltage; and wherein said oscillating step is accomplished by operating the oscillation system in response to the square-wave signal to oscillate the nozzle at the frequency of the square-wave signal, the color jet producing a marking upon the occurrence of an ascending flank of each pulse and upon the occurrence of a descending flank of each pulse of the square-wave signal.

* * * * *